US011168508B2

(12) United States Patent
Dreyer

(10) Patent No.: US 11,168,508 B2
(45) Date of Patent: Nov. 9, 2021

(54) CONTROL SYSTEM FOR AN AUTOMATIC SLIDING DOOR

(71) Applicant: ASSA ABLOY ENTRANCE SYSTEMS AB, Landskrona (SE)

(72) Inventor: Roger Dreyer, Bjarred (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 158 days.

(21) Appl. No.: 16/494,219

(22) PCT Filed: Apr. 16, 2018

(86) PCT No.: PCT/EP2018/059671
§ 371 (c)(1),
(2) Date: Sep. 13, 2019

(87) PCT Pub. No.: WO2018/192877
PCT Pub. Date: Oct. 25, 2018

(65) Prior Publication Data

US 2021/0189788 A1 Jun. 24, 2021

(30) Foreign Application Priority Data

Apr. 18, 2017 (SE) ..... 1730105-2

(51) Int. Cl.
*E05F 15/00* (2015.01)
*E05F 15/74* (2015.01)
(Continued)

(52) U.S. Cl.
CPC ..... *E05F 15/74* (2015.01); *E05F 15/40* (2015.01); *E05F 2015/767* (2015.01);
(Continued)

(58) Field of Classification Search
CPC ..... E05F 2015/483; E05F 5/06; E05F 5/00; E05F 15/43; E05F 15/40; E05F 15/73;
(Continued)

(56) References Cited

U.S. PATENT DOCUMENTS 4,967,083 A 10/1990 Henning
6,329,774 B1 12/2001 Arie
(Continued)

FOREIGN PATENT DOCUMENTS

| | | |
|---|---|---|
| DE | 19522760 | 4/1997 |
| EP | 1243943 | 9/2002 |
| EP | 1655434 | 5/2006 |

OTHER PUBLICATIONS

International-Type Search Report mailed in ITS/SE17/00042 dated Nov. 15, 2017.

(Continued)

*Primary Examiner* — Chi Q Nguyen
(74) *Attorney, Agent, or Firm* — Wissing Miller LLP

(57) ABSTRACT

A control system for a sliding door operator system, having at least one sliding wing and a door header, includes a first sensor configured to define a first activation zone, a first wing presence zone and a first side presence zone, a second sensor configured to define a second activation zone, a second wing presence zone and a second side presence zone, and a controller configured to evaluate data from the first sensor and the second sensor for controlling operation of the at least one sliding wing in the sliding door operator system.

14 Claims, 8 Drawing Sheets

(51) Int. Cl.
*E05F 15/40* (2015.01)
*E05F 15/73* (2015.01)

(52) U.S. Cl.
CPC ..... *E05Y 2400/44* (2013.01); *E05Y 2400/45* (2013.01); *E05Y 2400/54* (2013.01); *E05Y 2600/45* (2013.01); *E05Y 2900/132* (2013.01)

(58) Field of Classification Search
CPC ..... E05F 15/60; E05F 15/70; E05F 15/632; E05F 2017/005; E05Y 2400/504; E05Y 2400/458; E05Y 2400/502; E05Y 2800/404; E05Y 2400/852; E05Y 2400/508; E05Y 2900/132; E05Y 2400/50; E05Y 2201/254; E05Y 2400/21; E05Y 2201/25; E05Y 2201/256; E05Y 2201/21; E05Y 2400/532; E05Y 2900/531
USPC ..... 49/31, 26, 28, 36; 250/221; 701/49, 701/301, 45, 36, 26; 340/901, 540; 318/480, 445
See application file for complete search history.

(56) References Cited

U.S. PATENT DOCUMENTS 7,941,972 B2 * 5/2011 Kamiya ..... E05F 15/632 49/360
7,977,903 B2 * 7/2011 Kamiya ..... E05F 15/44 318/469
8,280,593 B2 * 10/2012 Nakakura ..... E05F 15/43 701/49
10,956,876 B2 * 3/2021 Dreyer ..... E05F 15/60
2003/0105559 A1 * 6/2003 Avenel ..... G07C 9/00309 701/2
2006/0160484 A1 * 7/2006 Falk ..... E06B 3/90 454/195
2006/0162254 A1 7/2006 Takashi
2007/0094932 A1 5/2007 Kaoru
2010/0076651 A1 * 3/2010 Nakakura ..... G01S 7/4811 701/49
2010/0082206 A1 * 4/2010 Kollar ..... E05F 15/43 701/49
2012/0212353 A1 * 8/2012 Fung ..... B60W 30/08 340/905
2014/0115965 A1 * 5/2014 Raynal ..... E05F 15/79 49/31
2016/0001781 A1 * 1/2016 Fung ..... B60K 28/02 701/36
2020/0013021 A1 * 1/2020 Dreyer ..... E05F 15/60
2020/0208459 A1 * 7/2020 Trobro ..... E05F 15/603

OTHER PUBLICATIONS

International Search Report mailed in PCT/EP2018/059671 dated Jul. 19, 2018.

* cited by examiner

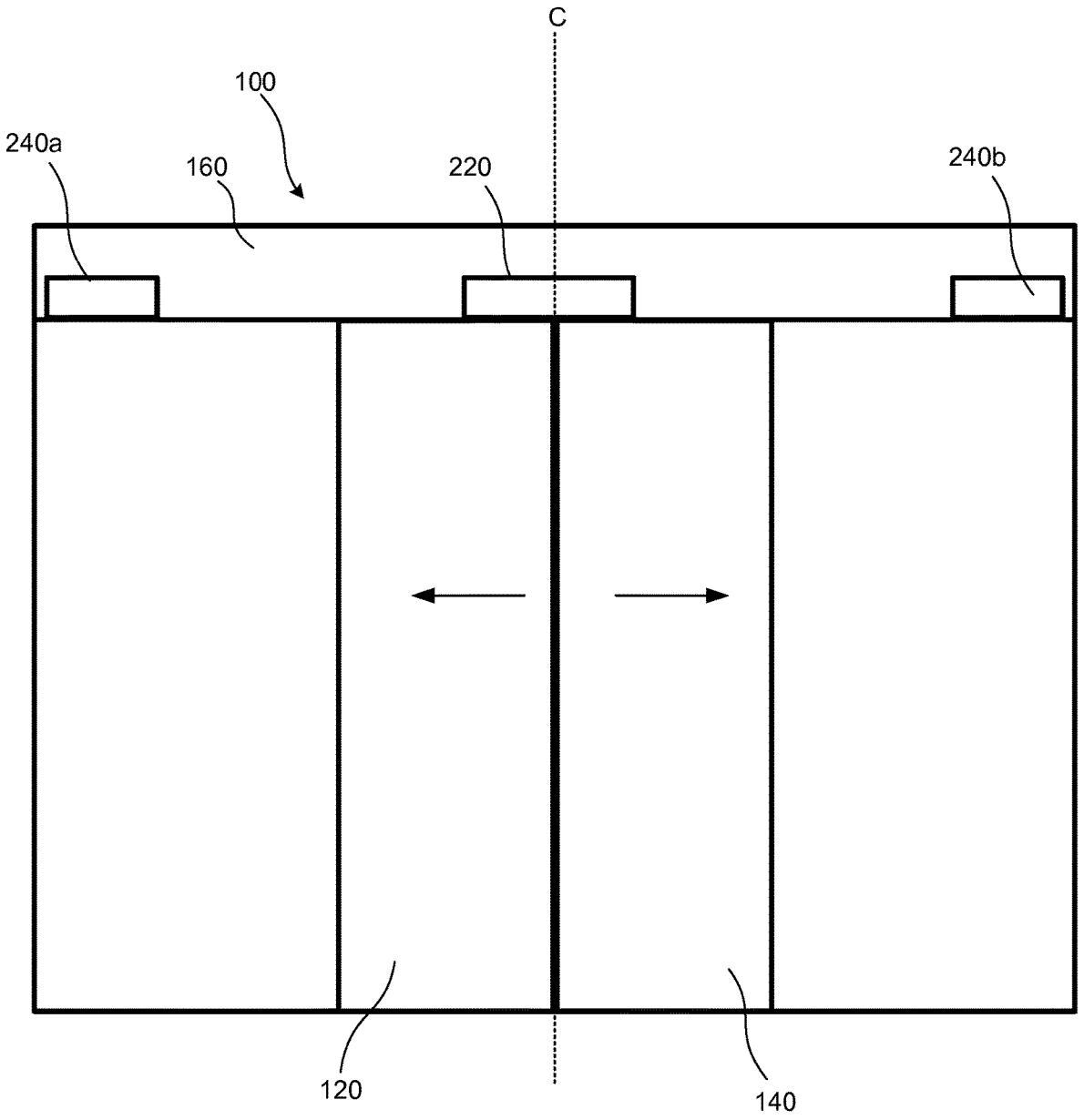
*Fig. 1 – PRIOR ART*

CONTROL SYSTEM FOR AN AUTOMATIC SLIDING DOOR

This application is a 371 of PCT/EP2018/059671 filed on Apr. 16, 2018, published on Oct. 25, 2018 under publication number WO 2018/192877, which claims priority benefits from Swedish Patent Application No. 1730105-2 filed on Apr. 18, 2017, the disclosure of which is incorporated herein by reference.

TECHNICAL FIELD

The present invention relates to the technical field of automatic doors. More specifically, the present invention relates to a control system for operating an automatic sliding door. The present invention also relates to a door operating system comprising such a control system.

BACKGROUND

Automatic sliding doors frequently use a control system to detect conditions for automatically opening and/or closing the door. Different kinds of approach sensors can be used to determine when an object, such as a person, is approaching the door. The sensor may for example use micro-wave radiation or infra-red radiation to determine when an object is approaching the door.

Since it is important that the automatic sliding door is safe to use, it may be desired to have a plurality of safety sensors that detect presence of an object within an immediate area of the doors in order to reduce the risk of a person getting stuck between the doors. Such a safety sensor often uses infra-red radiation.

Such a prior art system is shown in FIG. 1, disclosing a sliding door arrangement according to a prior art solution. The arrangement includes a sliding door assembly having at least one sliding wing 120, 140. The sliding wings are moved in a running rail by an automatic door operator (not shown) arranged as a concealed overhead installation in at the door header 16. The operation of the sliding door system controlled by the automatic door operator which comprises a control system. The control system detects conditions in the surrounding area of the sliding door system 100 to determine if the sliding wings 120, 140 are to be opened/closed. The control system comprises, on each side of the sliding door, a first sensor 220 arranged in the center axis C of the sliding door system 1. The first sensor 220 is arranged to function as both a motion sensor and a presence sensor, i.e. to determine both when an object is approaching and when an object is present in the vicinity of the area between the two sliding wings 120, 140. The control system further comprises two side sensors 240*a*, 240*b* arranged at each respective ends of the sliding door arrangement 100. The side sensors 240*a*, 240*b* are arranged to determine the presence of an object near the end portions of the sliding wings 120, 140 so as to minimize the risk that an object, such as a person, is jammed between one of the sliding wings and part of a surrounding structure.

However, there are situations where it is desired to reduce the number of sensors in order to save costs while maintaining the safety and reliability of the system.

Accordingly, there are rooms for improvements in the situations referred to above.

SUMMARY

An object of the present invention is therefore to provide a solution to or at least a mitigation of one or more of the problems or drawbacks identified in the background section above.

The present inventors have realized, after insightful consideration, that the control system for a sliding door operator system may be provided in a novel and inventive way, which avoids the drawbacks above. By appropriately configuring a controller and arranging at least one sensor in the sliding door operator system movements of objects, such as persons, can be detected with higher efficiency and/or at a reduced cost.

A first aspect of the present invention is a control system for a sliding door operator system having at least one sliding wing and a door header. The control system comprises a first sensor configured to define at least a first activation zone, a first wing presence zone and a first side presence zone and a second sensor configured to define a second activation zone, a second wing presence zone and a second side presence zone. The system further comprises a controller configured to evaluate data from the first and second sensor for controlling the operation of the at least one sliding wing in the sliding door operator system.

By having a sensor capable of detecting both when a person is approaching the door (activity detection) and when a person is in the vicinity of the sliding wings of the door (presence detection), the number of sensors needed in the system will be reduced. Furthermore, the sensor can be arranged on both side, i.e. right or left, of the center axis of the sliding door operator system. This significantly reduces the manufacturing costs.

The controller may further be configured to evaluate data from the second sensor for controlling the operation of the at least one sliding wing in the sliding door operator system. The first sensor and the second sensor may be arranged on the same side of the door header of the sliding door operator system.

In one embodiment the first and second sensor are arranged on the same side of the door header of the sliding door operator system such that the first activation zone and the second activation zone are at least partly overlapping.

By having two identical sensors, where each sensor is capable of detecting both when a person is approaching the door (activity detection) and when a person is in the vicinity of the sliding wings of the door (presence detection), the number of sensors needed in the system will be reduced. This significantly reduces the manufacturing costs. Furthermore, thanks to the arrangement of the two sensors there will be an overlap in the registered detection zone(s), which will increase the detection accuracy. This approach solves or at least mitigates one or more of the problems or drawbacks identified in the background section above, as will be clear from the following detailed description section.

A second aspect of the present invention is a sliding door operating system. The sliding door operating system comprises a control system according to the teachings herein, an automatic door operator, a door header and a sliding door assembly having at least one sliding wing.

A third aspect of the present invention is a method for controlling the operation of the at least one sliding wing in a door operating system which furthermore comprises a controller, a first sensor and a second sensor. The door operating system further as a door header, whereby the first and second sensor are arranged on the same side of the door header of the door operating system. The method comprises defining a first activation zone, a second activation zone, a first wing presence zone, a second wing presence zone, a first side presence zone and a second side presence zone, detecting a change in the first or second activation zone, in the first or second wing presence zone and/or in the first or second side presence zone, evaluating the detected change and determining, based on said evaluated change, the operation of the at least one sliding wing.

Embodiments of the invention are defined by the appended dependent claims and are further explained in the detailed description section as well as on the drawings.

It should be emphasized that the term "comprises/comprising" when used in this specification is taken to specify the presence of stated features, integers, steps, or components, but does not preclude the presence or addition of one or more other features, integers, steps, components, or groups thereof. All terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Objects, features and advantages of embodiments of the invention will appear from the following detailed description, reference being made to the accompanying drawings.

FIG. 1 is schematic front view of a prior art door operating system.

DETAILED DESCRIPTION OF EMBODIMENTS

Figure 2A:
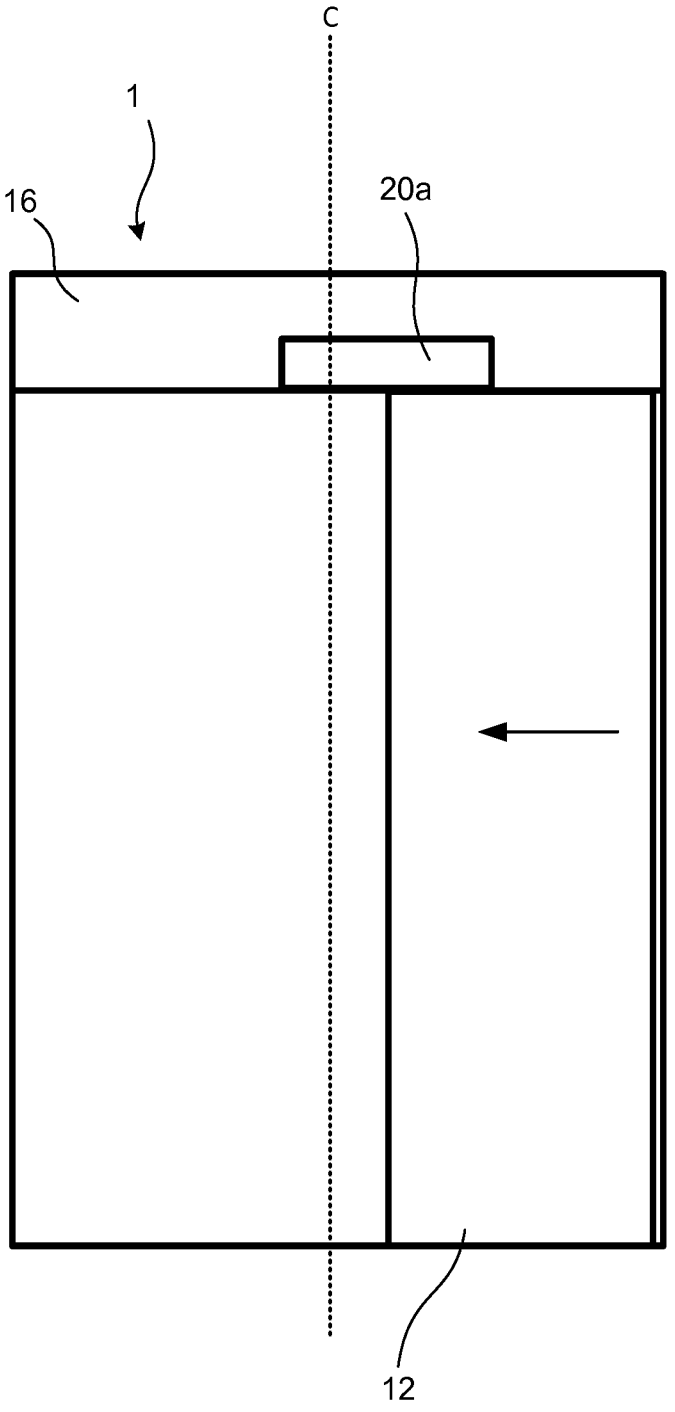
FIG. 2*a* is a schematic front view of a door operating system according to one embodiment.

Embodiments of the invention will now be described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

FIG. 2*a* is a schematic front view of a door operating system 1. The sliding door operating system 1 comprises a sliding door assembly having at least one sliding wing 12. The sliding wing 12 is guided displaceably in a running rail (not shown). The sliding wings are moved by an automatic door operator (not shown) arranged in conjunction with the door header 16, typically as a concealed overhead installation in or at the door header 16. The header 16 may also may also function as a housing and/or a support and mounting structure for the sensors in the control system.

The door operator automatically controls the operation of the one or more sliding wings 12. The door operator is driven by a power source such as a drive motor, which preferably is arranged in the door operator in the door header 16.

The automatic door operator provides automatic opening and closing of the wing(s) 12 in various possible applications including, for instance, providing access through entrance ports or internal doors at office premises, industries, retail stores or hotels, etc. The door system 1 disclosed herein is thus suitable for both external and internal use, i.e. can be arranged so that one side of the door is arranged to face the outside of a building or arranged completely contained in a building. The sliding wing(s) 12 may be a door design made from one or more suitable materials such as glass, wood, metal, plastic or composite material.

The operation of the sliding door system is controlled by the automatic door operator which comprises a control system. The control system detects conditions in the surrounding area of the sliding door system 1 to determine if the sliding wing 12 is to be opened/closed. Preferably, the door should only be opened if a person approaches the door, thus intending to use the door, and not when a person is walking away from the door. Additionally, it would be beneficial if the control system could detect and evaluate the situation when the area surrounding the door permanently changes such as when a door mat is placed or removed, change of place or size of a merchandise display and/or snow buildup. It is also important that an object, such as an animal, person or a device, is not jammed between the sliding wings 12 (if more than one) or between a sliding wing and a part of a surrounding structure, such as a building wall, and the presence of obstructing objects in the movement area of the sliding wing 12 should thus be monitored.

The present invention takes into account all the above issues, and more, by providing an improved control system for a sliding door system. Due to the construction of the control system the number of sensors is reduced, which significantly reduces the manufacturing costs.

Figure 3A:
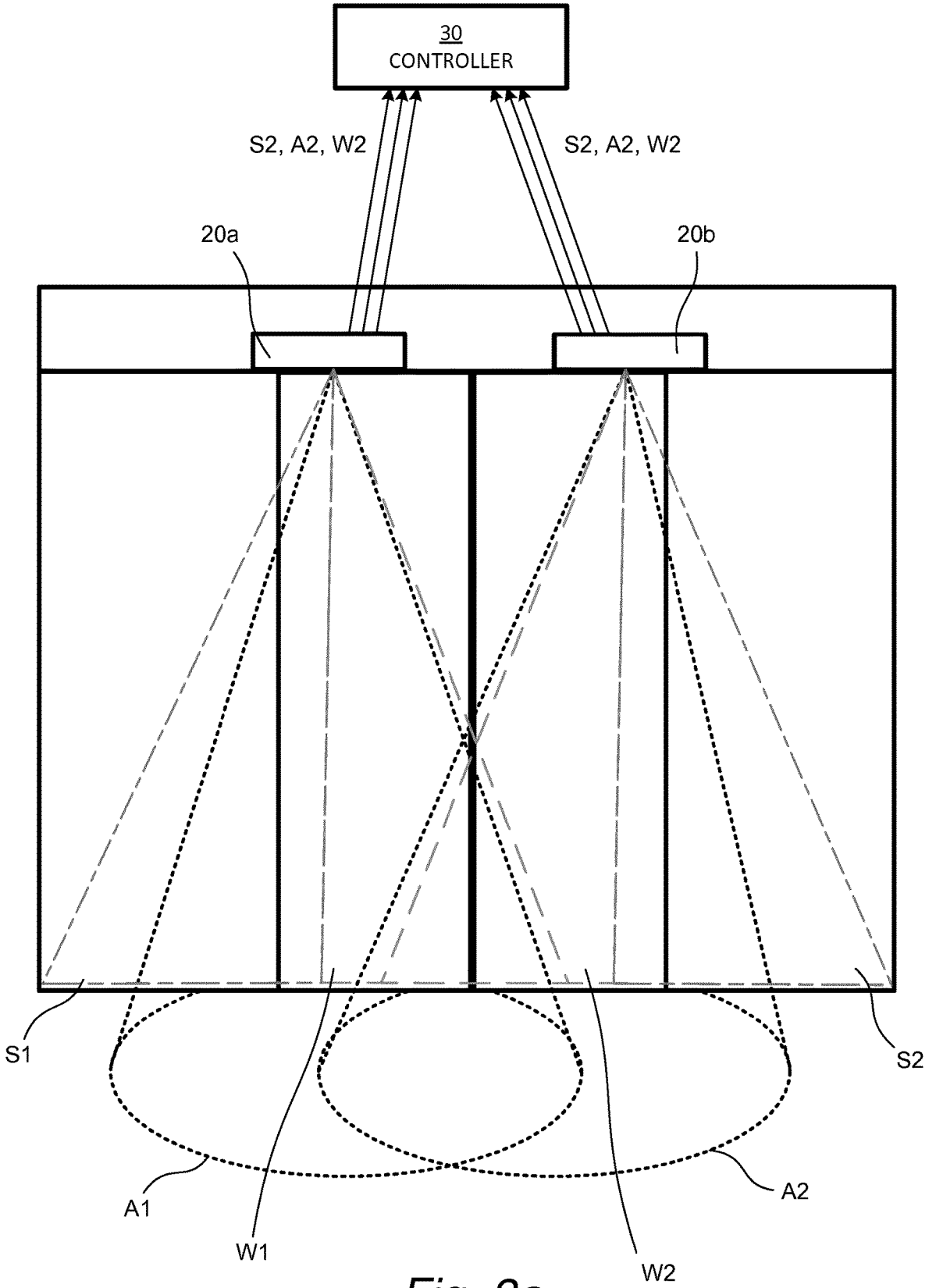
FIG. 3*a* is a schematic front view schematically illustrating detection zones defined by a control system according to an embodiment.

In the embodiment shown in FIG. 2*a*, the control system comprises a first sensor 20*a*. The sensor 20*a* is preferably arranged on or in the door header 16, in an operator cover or in the ceiling close to the door. The sensor 20*a* is configured to function as both a presence sensor and an activation sensor. The sensor 20*a* is configured to define a first activation zone A1 used to detect when an object, such as a person, is approaching the sliding wing 12, a first wing presence zone W1 used to detect presence of an object in the near vicinity of the sliding wing 12 and a first side presence zone S1 used to detect presence near the end of the sliding wing 12 (as illustrated in FIG. 3*a*). In this arrangement, there is thus no longer a need for a separate side sensor as described in the prior art system with reference to FIG. 1, since the single sensor 20*a* is capable of also detecting side presence.

Figure 2B:
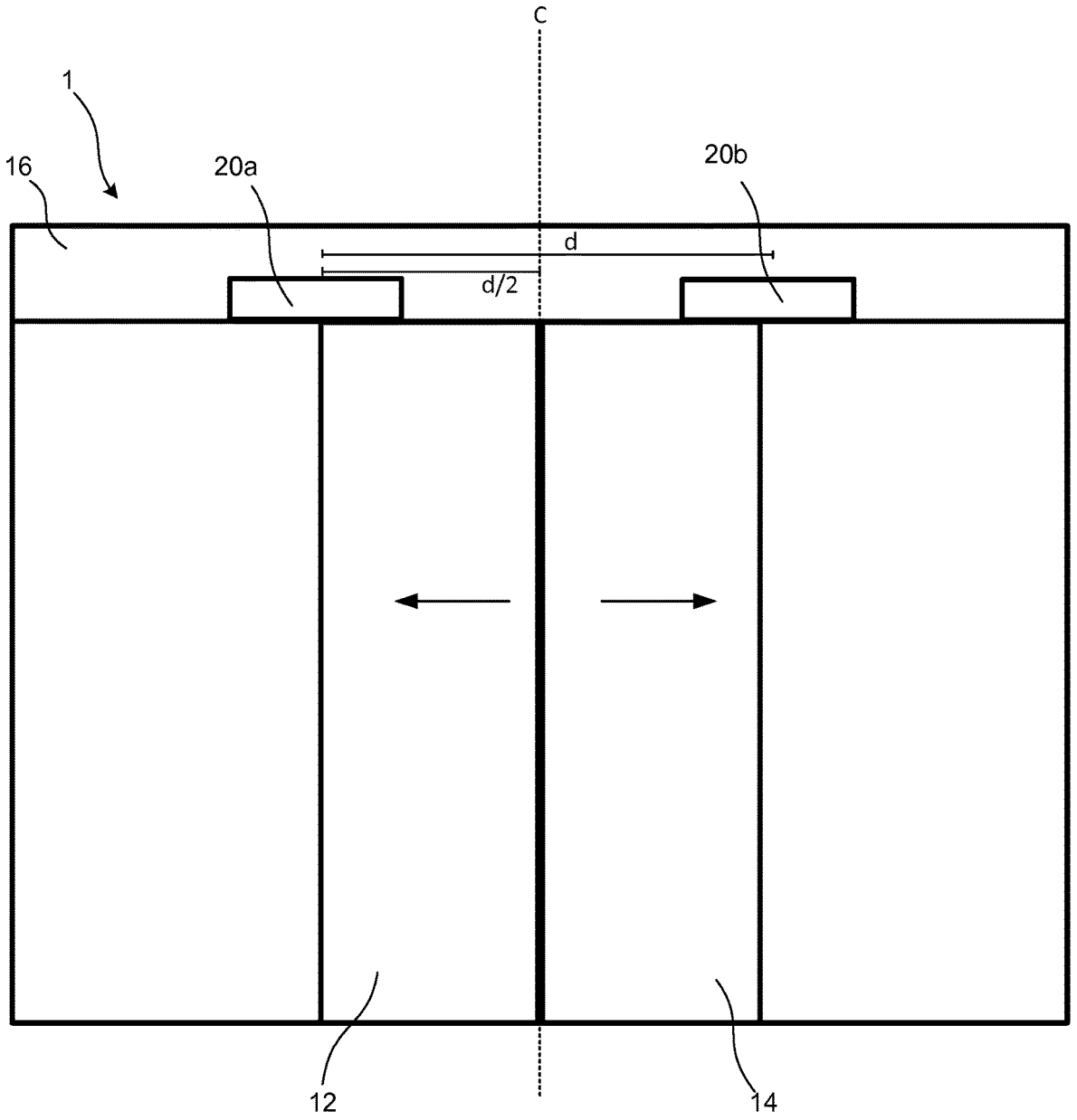
FIG. 2*b* is a schematic front view of a door operating system according to one embodiment.

In one embodiment as shown in FIG. 2*b* the sliding door system 1 comprises two sliding wings 12, 14. In the embodiment shown in FIG. 2*b*, the control system comprises a first sensor 20*a* and a second sensor 20*b*. The first and second sensor 20*a*, 20*b* are substantially identical in type and construction and both sensors are adapted to function as both a motion sensor and a presence sensor. Each sensor may have a separate housing modules or be arranged in the same housing.

Thanks to the first and second sensor 20*a*, 20*b* being identical in type, the control system disclosed herein provides a more reliable control over a sliding door system than in the prior art system as described with reference to FIG. 1. The two identical sensors 20*a*, 20*b* provide redundancy measurements. This is beneficial if one of the two combined sensors 20*a*, 20*b* is malfunctioning, since the control system still will be able to provide accurate information in most of the areas around the sliding door system. This is especially true for the areas which are covered by the overlapping detection zones defined by the two sensors 20*a*, 20*b*, as will be described more in detail with reference to FIG. 3*a*.

The sensors are preferably arranged on or in the door header 16, in an operator cover or in the ceiling close to the door. The two sensors 20*a*, 20*b* are arranged on the same side of the door. The first and second sensor 20*a*, 20*b* are arranged with a distance d between each other. Each sensor is arranged at a distance d/2 from the center axis C of the sliding door system 1. The distance d between the first and second sensor 20*a*, 20*b* are such that sufficient detection zones are obtained.

As will be described more with reference to FIG. 3*a*, the two sensors 20*a*, 20*b* may be arranged such that the detection zones covered by the sensors 20*a*, 20*b* at least partly overlap.

The first and second sensor 20*a*, 20*b* may be arranged on one side of the door, that side may be the entrance. The first and second sensor 20*a*, 20*b* may also be arranged on the other side of the door, i.e. the exit side. In some embodiments, a first and a second sensor 20*a*, 20*b* are arranged on both sides, i.e. both on the entrance side and on the exit side. In such a system the control system may comprise four sensors, or the system comprises two separate control systems.

The detection zones covered by the first and second sensors 20*a*, 20*b* are illustrated in FIG. 3*a*. As already described, each sensor 20*a*, 20*b* is configured to both detect when a person approaches the door (activity detection) and to detect if there are any obstacles in the movement area of the sliding wing 12, 14 (presence detection). The sensors 20*a*, 20*b* each has an activation zone A1, A2. The first sensor 20*a* defines a first activation zone A1 and the second sensor 20*b* defines a second activation zone A2. The information gathered from the activation zones A1, A2 is used as activation input, i.e. to determine if the sliding wings 12, 14 are to be opened or not. In the disclosure herein the term defined, covered or generated in the sense of creating a detection zone is intended to have the same meaning.

Each activation zone A1, A2 faces out from the door in the form of a lobe and the activation zones A1, A2 from the first and second sensor 20*a*, 20*b* are partly overlapping each other. In one embodiment, each activation zone A1, A2 is 2 to 4 meters wide, in the opening direction of the sliding wings 12, 14, and 2 to 2.5 meters long in the direction perpendicular to the opening direction of the sliding wings 12, 14.

Each sensor 20*a*, 20*b* also creates a wing presence zone W1, W2. The first sensor 20*a* generates a first wing presence zone W1 and the second sensor 20*b* generates a second wing presence zone W2. The wing presence zone W1, W2 each covers the zone in the vicinity of the opening area of the sliding wings 12, 14. The wing presence zone W1, W2 extends in the direction of movement of the sliding wings 12, 14. The information obtained in the wing presence zones W1, W2 is used to prevent persons or other objects from being clamped or jammed between the sliding wings 12, 14 when the door is being closed. The wing presence zones W1, W2 may be partly overlapping each other as well as overlapping with the activation zones A1, A2.

The overlapping zones W1, W2 and A1, A2 are used as redundancy measurements. If one of the two combined sensors 20*a*, 20*b* stops working, the control system will still be able to provide accurate information in the overlapping areas W1, W2 and A1, A2. For example, if the first sensor 20*a* malfunctions, the control system will still be able to gain information from the detection zones A2, W2 and S2 defined by the second sensor 20*b*. Thanks to the inventive arrangement of the first and second sensors 20*a*, 20*b* the most important areas around the sliding door system will still be covered.

Furthermore, each sensor 20*a*, 20*b* has a side presence zone S1, S2. The first sensor 20*a* generates a first side presence zone S1 and the second sensor 20*b* generates a second side presence zone S2. The side presence zone S1, S2 covers the zone near the end portions of the door system 1, i.e. the part of the door that is facing the surrounding walls. The information gathered from the side presence zones S1, S2 is used to prevent objects from being clamped or jammed between the wall and a sliding wing 12, 14. Each side presence zone S1, S2 may partly overlap with the corresponding activation zone A1, A2. Additionally or alternatively, in some embodiments each side presence zone S1, S2 partly overlaps with the corresponding wing presence zone W1, W2.

Figure 3B:
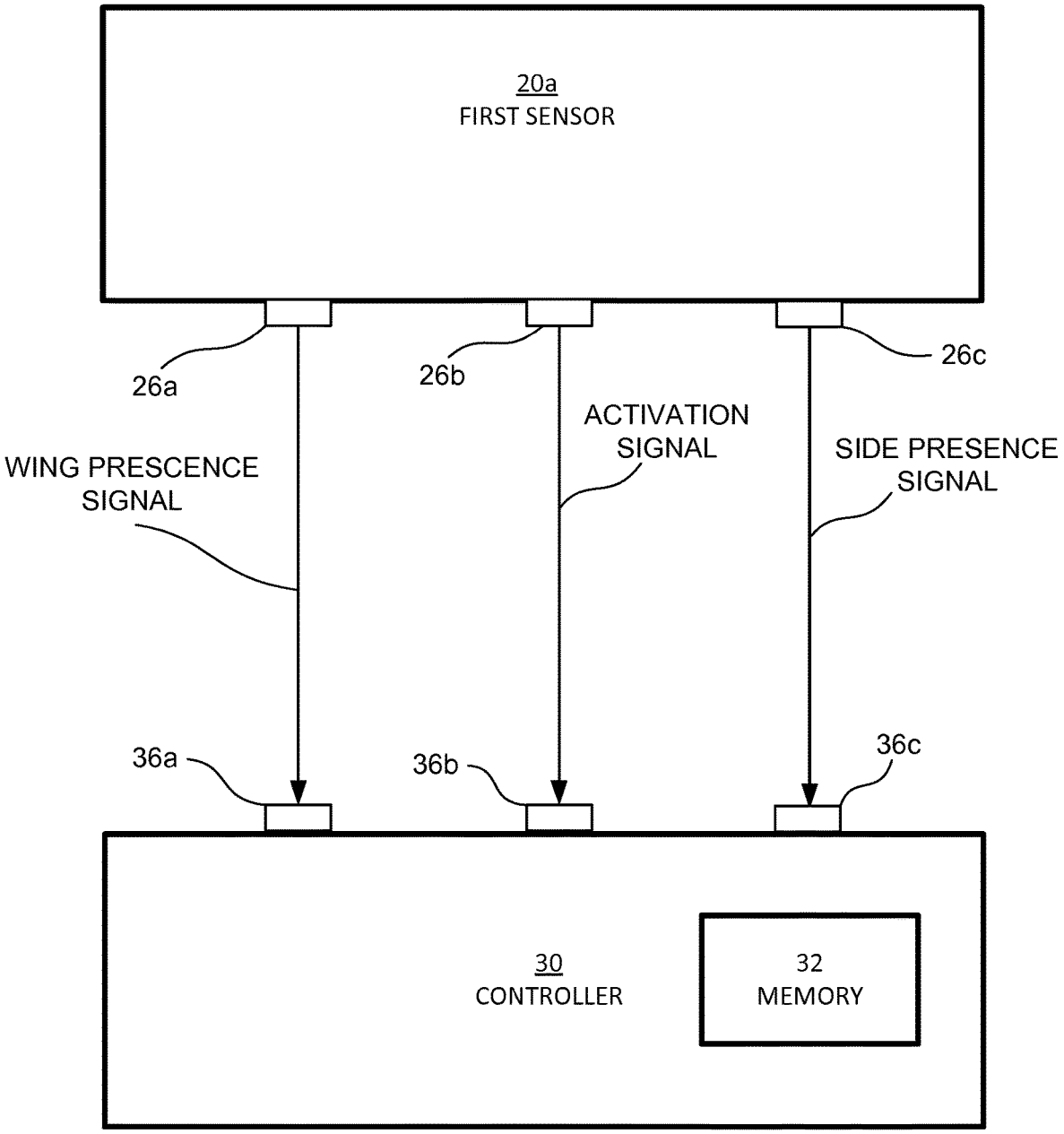
FIG. 3*b* is a schematic block diagram of a control system for door operating system according to an embodiment.

The system further comprises a controller 30 adapted to evaluate data from at least the first sensor 20*a* for controlling the operation of the at least one sliding wing 12, 14 in the sliding door operator system 1. FIG. 3*b* shows an embodiment where the system comprises a first sensor 20*a* and a controller 30. The sensor 20*a* has three outputs 26*a*, 26*b*, 26*c*; a wing presence output 26*a*, an activation output 26*b* and a side presence output 26*c*. The sensor 20*a* transmits three signals, wing presence signal, activation signal and a side presence signal, to the controller 30 from the three outputs 26*a-c*. The wing presence signal is generated from the first wing presence zone W1, the activation signal is generated from the first activation zone A1 and the side presence signal is generated from the side presence zone S1. The signals may be transmitted continuously or at predetermined time intervals.

The controller 30 has three inputs 36*a*, 36*b*, 36*c* where each input corresponds to an output 26*a-c* of the sensor 20*a*. Hence, the controller 30 has a wing presence input 36*a*, an activation input 36*b* and a side presence input 36*c*.

This arrangement allows for easy configuration of the sensor 20*a* since the sensor 20*a* can be arranged both on a right side or a left side of the center axis C of the sliding door operator system. By switching the wing presence signals with the side presence signal and switching the wing presence input 36*a* with the side presence input 36*c* of the controller 30, the system may be configured for either a right side or a left side configuration. If the sensor 20*a* shown in FIG. 3*b* is arranged as shown in FIG. 2*a*, i.e. the sensor 20*a* is arranged on a left side of the center axis the sensor 20*a* could easily be arranged to be placed on a right side by switching the position of the side presence signal and the wing presence signal.

Although FIG. 3*b* illustrates only a first sensor 20*a*, it should be understood, that since the first and second sensors 20*a*, 20*b* are identical in structure, the same applies to the relation between the second sensor 20*b* and the controller 30. The first and second sensor 20*a*, 20*b* are identical in structure but may have reversed inputs 36*a-c* in the controller 30 to facilitate for one sensor being arranged on the right side, and the other sensor being arranged on the left side of the center axis C.

The controller 30 may be implemented in any known controller technology, including but not limited to microcontroller, processor (e.g. PLC, CPU, DSP), FPGA, ASIC or any other suitable digital and/or analog circuitry capable of performing the intended functionality.

The controller 30 has an associated memory 32. The memory 32 may be implemented in any known memory technology, including but not limited to E(E)PROM, S(D) RAM or flash memory. In some embodiment, the memory 32 may be integrated with or internal to the controller 30. The memory 32 may store program instruction for execution by the controller 30, as well as temporary and permanent data used by the controller 30.

Figure 3C:
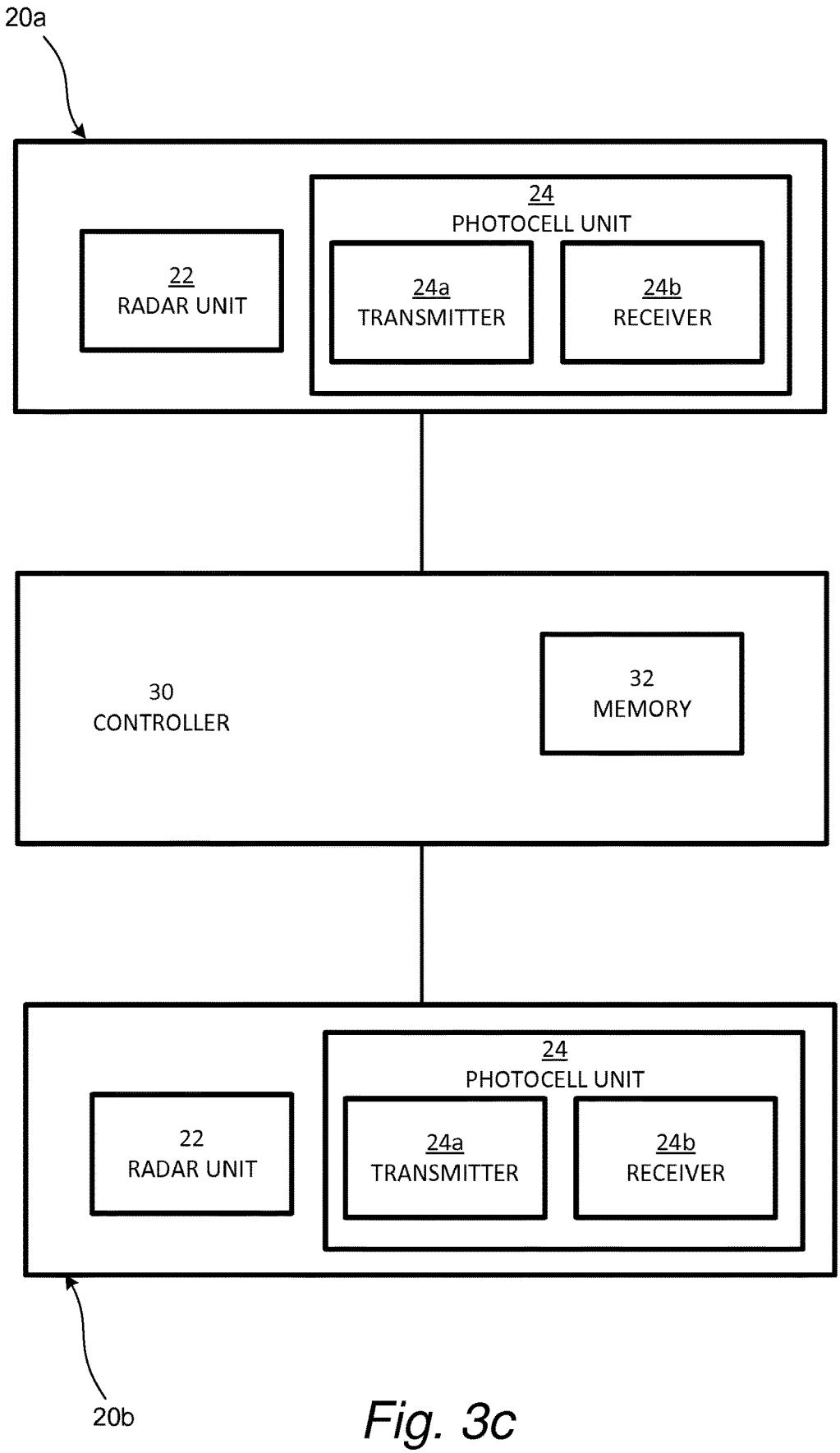
FIG. 3*c* is a schematic block diagram of a control system for door operating system according to an embodiment.

The control system is schematically illustrated in FIG. 3*c* comprising a first sensor 20*a*, a second sensor 20*b* and a controller 30. In one embodiment the first and second sensor 20*a*, 20*b* is a combined radar and photocell sensor. The radar unit 22 uses microwave technology preferably using frequencies on the IEEE K-band, i.e. ranging between 18 and 27 GHz. More preferably, the frequency used is around 24 GHz. The radar unit 22 acts as both a transmitter and receiver and operates with the Doppler principle. Hence, the radar unit 22 registers and compares the transmitted signal with the reflected signal. The reflected signal from a moving object is at a different frequency than the transmitted signal and the receiver thus detects the frequency difference and triggers an impulse to the controller 30.

The radar unit 22 comprises an antenna. Depending on the antenna arranged in the radar unit 22, different sizes and shapes of the detection zone can be achieved. The antenna could for example be a standard antenna or a radio access network (RAN) antenna.

Preferably, the radar unit is direction-sensing (uni-directional) and is configured to in the detection zone differentiate between when a person is approaching the door or moving away from it. The radar unit may also be motionsensing (bi-directional), i.e. sensing when a person is moving inside the detection zone regardless of whether the person is moving away from or towards the door. The main task of the radar unit 22 of the sensor 20*a*, 20*b* is activity detection, i.e. to determine presence of a person in the detection zone, so as to determine opening and closing of the door. The detection zone defined by the radar unit is hereinafter referred to as an activation zone.

The photocell unit 24 uses infrared technology to determine presence detection in and around the sliding wings 12, 14. The photocell unit 24, or presence unit, may use active infrared technology (AIR). The photocell unit 24 comprises an IR transmitter 24*a* that send a beam of infrared light and an IR receiver 24*b* which receives the beam. The IR transmitter 24*a* emits pulsed IR radiation to define the detection zone. Radiation reflected from the detection zone is received by the IR receiver. The photocell unit 24 is configured to evaluate any shift in the frequency range of the received beam, and thus detect an object in the detection, or presence, zone. The photocell unit 24 may use background analysis, i.e. the unit uses the background as a reflector.

The IR transmitter 24*a* comprises a plurality of IR transmitter elements arranged in a matrix. In one embodiment, the matrix comprises three rows of IR transmitter elements and 24 columns of IR transmitter elements.

Hence, the IR transmitter 24*a* comprises 72 transmitter elements in total. In another embodiment, the IR transmitter 24*a* comprises a matrix comprising two rows of IR transmitter elements and 24 columns of IR transmitter elements, so that the total number of IR transmitter elements is 48. However, it should be understood that the matrix may have any number of rows and columns of IR transmitters elements could be used with the present invention. Preferably, the matrix of IR transmitter elements are arranged along the whole length of the side of the door system.

Although the embodiment described with reference to FIG. 3*c* relates to a sensor 20*a*, 20*b* comprising a photocell unit 24 and a radar unit 22, it should be noted that any type of sensor could be used in the present invention as long as it is capable of defining three different zones; a activation zone, a side presence zone and a wing presence zone. The sensor 20*a*, 20*b* may for example use microwave radar, active IR, passive IR, Time of Flight, video analysis and/or ultrasonic technology.

The outputs from the first and second sensor 20*a*, 20*b* are analyzed by the controller 30. As will now be described more with reference to FIG. 4*a-b*, the controller 30 is configured to evaluate data from the first and second sensor 20*a*, 20*b* for controlling the opening/closing of the sliding wings 12, 14. Accordingly, the controller 30 has a control output connected to the automatic door operator for controlling the motor thereof.

Figure 4A:
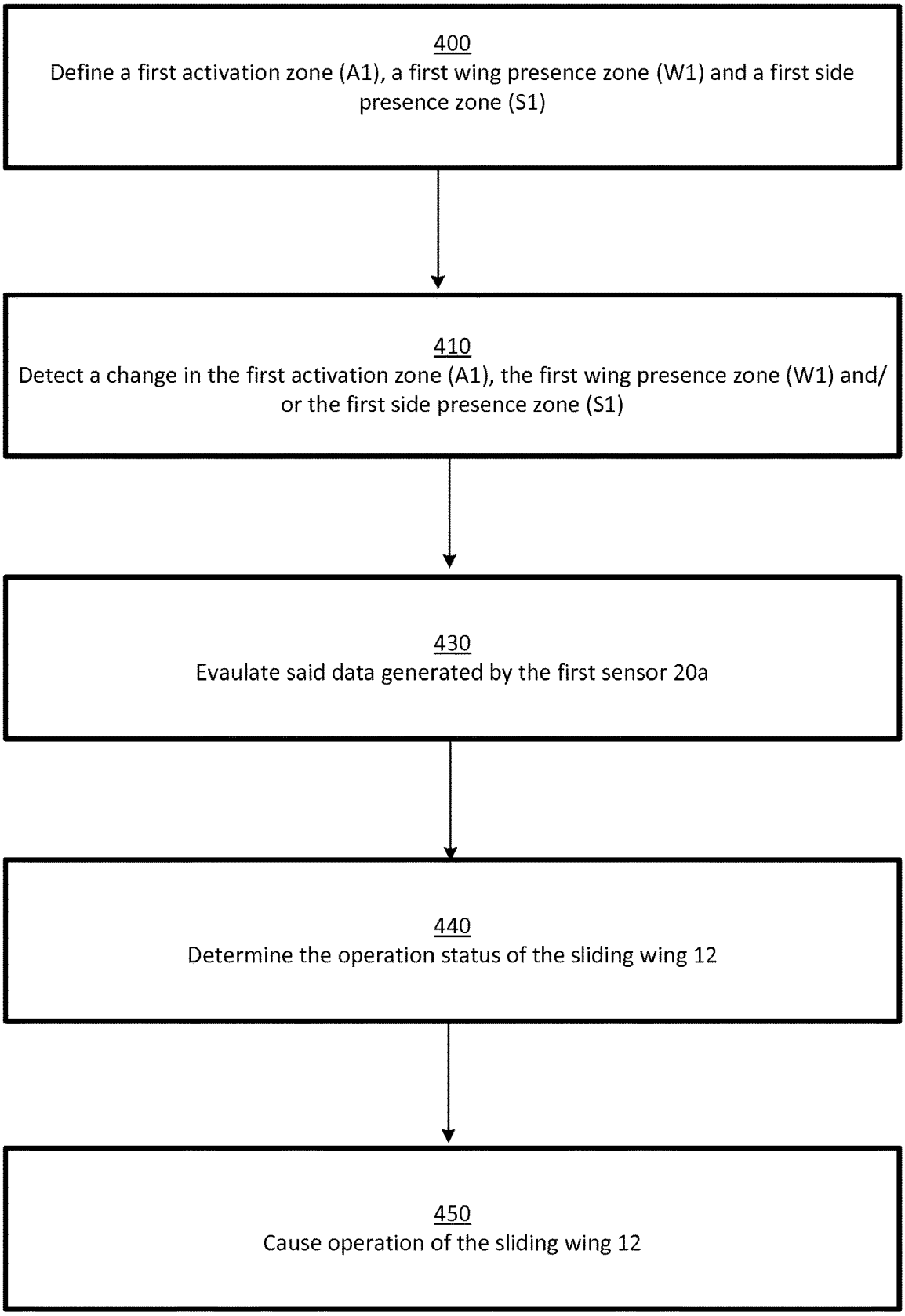
FIG. 4*a* is a flowchart diagram illustrating a method for operating a door operating system according to an embodiment.

FIG. 4*a* illustrates a method for controlling the operation of one sliding wing 12 in a door operating system comprising a controller 30 and a first sensor 20*a*. The controller 30 is configured to obtain the information from the different detection zones and based on said data determine the operation, i.e. opening/closing, of the sliding wing 12. In a first step, the first sensor 20*a* defines 400 a first activation zone A1, a first wing presence zone W1 and a first side presence zone S1. The control system then detects a change 410 in in the first activation zone A1, in the first wing presence zone W1 and/or in the first side presence zone S1. The change is detected using the first sensor 20*a* and/or by the controller 30. Hence, the first sensor 20*a* can detect 410 a change in the detection zones defined by the first sensor 20*a*, i.e. in the first activation zone A1, the first wing presence zone W1 and/or in the first side presence zone S1. The change in a detection zone may correspond to an object, such as a person, approaching or being present in the sliding door system.

The controller 30 of the control system evaluates 430 the data generated by the first sensor 20*a*. Based on that data, the controller determines 440 the operating conditions of the sliding wing 12, i.e. if the sliding wing is to be opened or closed. The door operating system will then cause 450 operation of the sliding wing 12.

The door operating system further has a door header, whereby the first sensor 20*a* and the second sensor 20*b* are arranged on the same side of the door header of the door operating system.

Figure 4B:
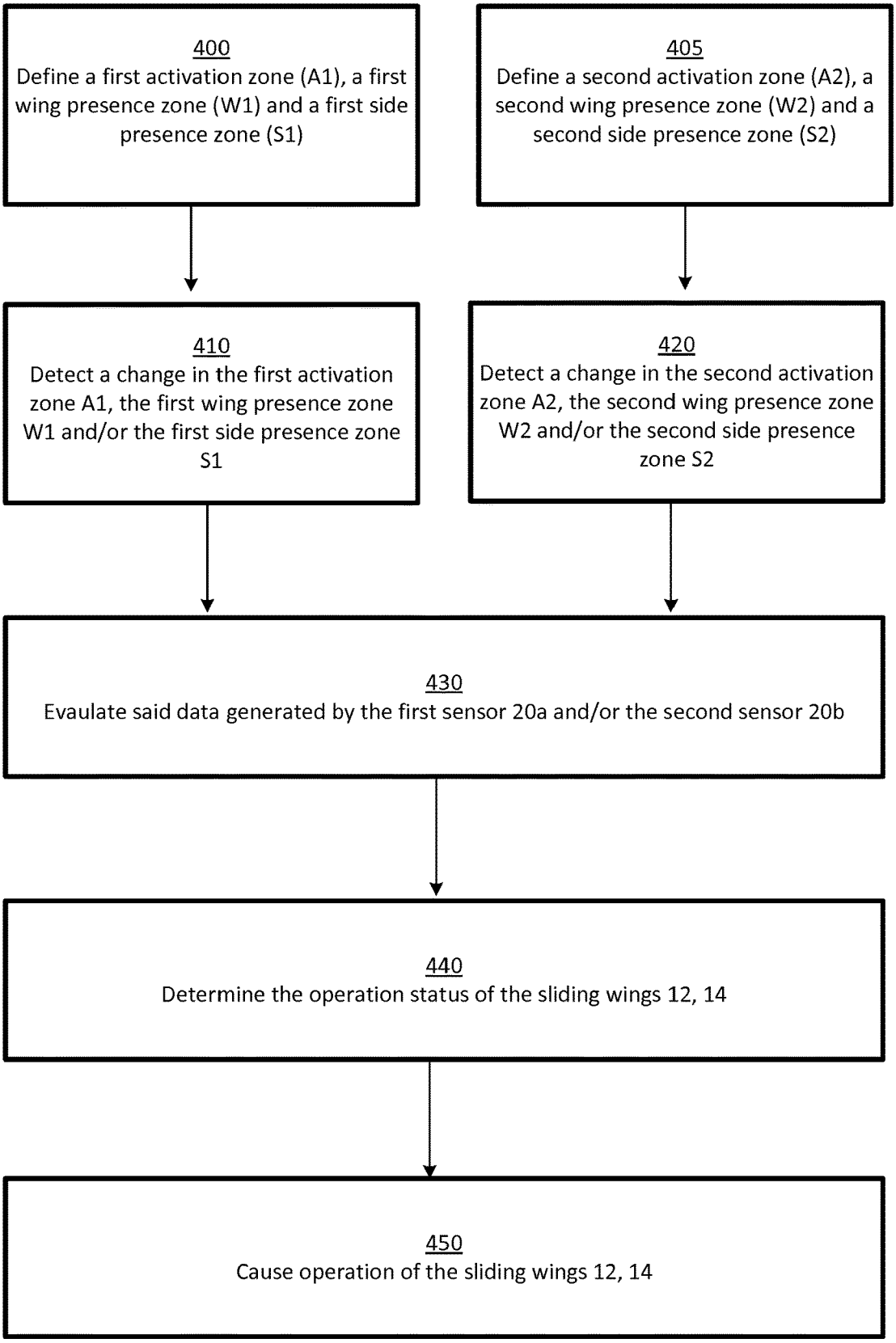
FIG. 4*b* is a flowchart diagram illustrating a method for operating a door operating system according to an embodiment.

FIG. 4*b* illustrates a method for controlling the operation of two sliding wings 12, 14 in a door operating system comprising a controller 30, a first sensor 20*a* and a second sensor 20*b*. In a first step, the first sensor 20*a* defines 400, 405 a first and a second activation zone A1, A2, a first and a second wing presence zone W1, W2 and a first and a second side presence zone S1, S2. The control system then detects a change 410, 420 in in the first and/or second activation zone A1, A2, in the first and/or second wing presence zone W1, W2 and/or in the first and/or second side presence zone S1, S2. The change is detected using the first and the second sensor 20*a*, 20*b* and/or the controller 30. Hence, the first sensor 20*a* can detect 410 a change in the detection zones defined by the first sensor 20*a*, i.e. in the first activation zone A1, the first wing presence zone W1 and/or in the first side presence zone S1. Accordingly, the second sensor 20*b* can detect 420 a change in the detection zones defined by the second sensor 20*b*, i.e. in the second activation zone A2, the second wing presence zone W2 and/or in the second side presence zone S2.

The controller 30 of the control system evaluates 430 the data generated by the first and/or second sensor 20*a*, 20*b*. Based on that data, the controller determines 440 the operating conditions of the sliding wings 12, 14, i.e. if the sliding wings are to be opened or closed. The door operating system will then cause 450 operation of the at least one sliding wing 12, 14.

If a change is detected in an area being defined by overlapping detection zones, both the first and the second sensor 20*a*, 20*b* will detect the change. In one embodiment, the redundancy in information from the sensors 20*a*, 20*b* is disregarded as long as both the first and second sensors 20*a*, 20*b* are functioning properly. If the system detects, or is notified, that one of the two sensors is not properly functioning, no redundancy is generated and all information gathered from the functioning sensor 20*a*, 20*b* is used.

In one embodiment, the redundancy in information from the sensors 20*a*, 20*b* are summarized or in other way combined by the controller 30.

In one embodiment, the controller 30 is configured to combine the data obtained from the overlapping zone(s) so as to gain a higher accuracy in said overlapping zone(s). In this way the accuracy of the generated data is increased. Since the overlapping zone is around the central axis C of the door, where people most frequently enters, the accuracy of the control system is greatly increased. The combined data is then evaluated by the controller 30 in order to determine the operation of the at least one sliding wing.

The controller 30 is configured to determine the operation of the at least one sliding door wing based on the evaluated data from the first sensor 20*a* and the second sensor 20*b*. The controller 30 is thus configured to evaluate the wing presence signals, side presence signals and activation signals from the first sensor 20*a* and second sensor 20*b* and based on the signals indicating a change, i.e. a presence in the associated zones, determine a suitable operation of the door leaf. Thus, the operation of the door leaf may be determined with only two sensors which allows for a system allowing for operation of the door leaf while being more cost-efficient and easier to diagnose in case of malfunction (due to the limited number of sensors required).

In a busy environment several objects and persons may be detected by the sensors at the same time. In such cases, the suitable operation of the door in response to changes detected by the sensors may differ from situations where only one object or person is present. For example, if a first person is detected in the first wing presence area W1 and a second person is detected in the second side presence area S2, the suitable operation may be to stop the movement of the door leaf completely.

To take this into account, the controller may be further configured to combine the evaluated data from the first sensor 20*a* and the second sensor 20*b*, whereby the controller 30 may be configured to determine the operation of the at least one sliding door wing based on said combination of data. This allows for intelligent operation of the door leaf in a busy environment, i.e. in situations where multiple objects or persons are present in the monitored zones, with a limited amount of sensors and a reduced complexity.

The invention has been described above in detail with reference to embodiments thereof. However, as is readily understood by those skilled in the art, other embodiments are equally possible within the scope of the present invention, as defined by the appended claims.

The invention claimed is:

1. A control system for a sliding door operator system having at least one sliding wing and a door header, the control system comprising:

a first sensor configured to define a first activation zone, a first wing presence zone, and a first side presence zone, the first side presence zone covering a portion of the at least one sliding door that faces a first adjacent wall;

a second sensor configured to define a second activation zone, a second wing presence zone, and a second side presence zone, the second side presence zone covering a portion of the at least one sliding door that faces a second adjacent wall; and a controller configured to evaluate data from the first sensor and the second sensor for controlling operation of the at least one sliding wing in the sliding door operator system;

wherein the first sensor is configured to transmit data, to the controller, in a form of a wing presence signal generated from the first wing presence zone, an activation signal generated from the first activation zone, and a first side presence signal generated from the first side presence zone, the first side presence signal identifying presence or absence of an object in the first side presence zone; and wherein the second sensor is configured to transmit data, to the controller, in a form of a wing presence signal generated from the second wing presence zone, an activation signal generated from the second activation zone, and a second side presence signal generated from the second side presence zone, the second side presence signal identifying presence or absence of an object in the second side presence zone;

whereby the first sensor and the second sensor are arranged on the same side of the door header of the sliding door operator system.

2. The control system as defined in claim 1, wherein the controller is configured to receive said signals to evaluate the data from the first sensor and the second sensor.

3. The control system as defined in claim 1, wherein the first sensor is structurally identical to the second sensor.

4. The control system as defined in claim 1, wherein the first sensor and the second sensor are arranged on the same side of the door header of the sliding door operator system such that the first activation zone and the second activation zone are partially overlapping.

5. The control system as defined in claim 4, wherein the controller is further configured to combine the data obtained from the overlapping zone(s) so as to gain a higher accuracy in the overlapping zone(s).

6. The control system as defined in claim 1, wherein the first wing presence zone is at least pal-partially overlapping with the first activation zone, and wherein the second wing presence zone is partially overlapping with the second activation zone.

7. The control system as defined in claim 1, wherein the first activation zone is defined by a radar unit arranged in the first sensor.

8. The control system as defined in claim 1, wherein the first wing presence zone and the first side presence zone are defined by a photocell unit arranged in the first sensor.

9. The control system as defined in claim 8, wherein the photocell unit comprises at least one IR-transmitter and at least one IR-receiver.

10. The control system as defined in claim 1, wherein the controller is configured to determine the operation of the at least one sliding door wing based on the evaluated data from the first sensor and the second sensor.

11. The control system as defined in claim 10, wherein the controller is configured to combine the evaluated data from the first sensor and the second sensor is configured to determine the operation of the at least one sliding door wing based on said combination of evaluated data.

12. A sliding door operating system, comprising:

a first sensor configured to define a first activation zone, a first wing presence zone, and a first side presence zone;

a second sensor configured to define a second activation zone, a second wing presence zone, and a second side presence zone;

an automatic door operator;

a door header; and a sliding door assembly having at least one sliding wing; and a controller configured to evaluate data from the first sensor and the second sensor for controlling operation of the at least one sliding wing in the sliding door operator system;

wherein the first sensor is configured to transmit data, to the controller, in a form of a wing presence signal generated from the first wing presence zone, an activation signal generated from the first activation zone, and a side presence signal that identifies presence or absence of an object in the first side presence zone covering a portion of the at least one sliding wing that faces a first adjacent wall;

wherein the second sensor is configured to transmit data, to the controller, in a form of a wing presence signal generated from the second wing presence zone, an activation signal generated from the second activation zone, and a side presence signal that identifies presence or absence of an object in the second side presence zone covering a portion of the at least one sliding wing that faces a second adjacent wall; and wherein the first sensor and the second sensor are arranged on the same side of the door header of the sliding door operating system.

13. A method for controlling an operation of at least one sliding wing in a door operating system comprising a controller, a first sensor and a second sensor, whereby the door operating system further has a door header, whereby the first sensor and the second sensor are arranged on the same side of the door header of the door operating system, the method comprising:

defining a first activation zone, a second activation zone, a first wing presence zone, a second wing presence zone, a first side presence zone and a second side presence zone;

detecting a change in the first or second activation zone, in the first or second wing presence zone, or in the first or second side presence zone, wherein said detecting the change in the first or second side presence zone comprises detecting presence or absence of an object near a portion of the at least one sliding wing that faces a first adjacent wall or a second adjacent wall;

evaluating the detected change; and determining, based on said evaluated change, the operation of the at least one sliding wing.

14. The method according to claim 13, wherein the first sensor and the second sensor are arranged on the same side of the door header of the sliding door operator system such that the first activation zone and the second activation zone are partially overlapping and wherein the evaluating step further comprises summarizing data originating from the overlapping detection zone.

* * * * *